US008980017B2

(12) United States Patent
Sasaki et al.

(10) Patent No.: US 8,980,017 B2
(45) Date of Patent: Mar. 17, 2015

(54) METHOD FOR MANUFACTURING STEEL PLATE WITH A LAYERED STRUCTURE

(75) Inventors: Yasushi Sasaki, Pohang (KR); Weonhui Lee, Suwon (KR)

(73) Assignee: Postech Academy-Industry Foundation, Pohang (KR)

( * ) Notice: Subject to any disclaimer, the term of this patent is extended or adjusted under 35 U.S.C. 154(b) by 365 days.

(21) Appl. No.: 13/456,702

(22) Filed: Apr. 26, 2012

(65) Prior Publication Data

US 2013/0000789 A1 Jan. 3, 2013

(30) Foreign Application Priority Data

Jun. 29, 2011 (KR) ..... 10-2011-0063978

(51) Int. Cl.

| | |
|---|---|
| ***C23C 8/14*** | (2006.01) |
| ***C23C 8/16*** | (2006.01) |
| ***C23C 8/02*** | (2006.01) |
| ***C23C 8/06*** | (2006.01) |
| ***C23C 8/10*** | (2006.01) |
| ***C23C 8/18*** | (2006.01) |
| ***C23C 8/80*** | (2006.01) |
| *C22C 38/46* | (2006.01) |

(52) U.S. Cl.

CPC ... *C23C 8/02* (2013.01); *C23C 8/06* (2013.01); *C23C 8/10* (2013.01); *C23C 8/14* (2013.01); *C23C 8/16* (2013.01); *C23C 8/18* (2013.01); *C23C 8/80* (2013.01)

USPC ..... 148/278; 148/582; 148/613; 148/615; 148/625; 148/629

(58) Field of Classification Search

CPC ..... C23C 8/06; C23C 8/08; C23C 8/10; C23C 8/12; C23C 8/14; C23C 8/16; C23C 8/18

USPC ..... 148/278, 582, 613, 615, 625, 629

See application file for complete search history.

(56) References Cited

U.S. PATENT DOCUMENTS

| | | | | |
|---|---|---|---|---|
| 3,951,697 | A * | 4/1976 | Sherby et al. | 419/23 |
| 5,575,973 | A * | 11/1996 | Choi et al. | 420/112 |
| 2012/0325375 | A1 * | 12/2012 | Sasaki et al. | 148/278 |

FOREIGN PATENT DOCUMENTS

| | | |
|---|---|---|
| KR | 1997-0700783 | 2/1997 |
| KR | 10-2000-0022552 | 4/2000 |
| KR | 10-2001-0056345 | 7/2001 |
| KR | 10-2005-0100701 | 10/2005 |

OTHER PUBLICATIONS

Ji Ook Park et al., "Direct Steel Sheet Production from Solid Pig Iron—Gaseous Decarburization of White Cast Iron", The Iron& Steel Technology Conference and Exposition, AISTech, May 3, 2011, vol. II, pp. 795-798.

* cited by examiner

*Primary Examiner* — Lois Zheng

(74) *Attorney, Agent, or Firm* — Lexyoume IP Meister, PLLC

(57) ABSTRACT

A method for manufacturing a steel plate provided with a layered structure. A method for manufacturing a steel plate includes: i) providing a high carbon steel plate; ii) homogenizing the high carbon steel plate; iii) transforming the high carbon steel plate into an austenitic phase by heating the high carbon steel plate; iv) contacting the high carbon steel plate with an oxidization gas and converting the high carbon steel plate into a steel plate comprising surface layers that are spaced apart from each other and are decarburized to be transformed into a ferritic phase, and a center layer that is located between the surface layers and is not decarburized; and v) cooling the high carbon steel plate and transforming the center layer into a martensitic phase.

9 Claims, 18 Drawing Sheets

METHOD FOR MANUFACTURING STEEL PLATE WITH A LAYERED STRUCTURE

CROSS-REFERENCE TO RELATED APPLICATION

This application claims priority to and the benefit of Korean Patent Application No. 1 0-201 1-0063978 filed in the Korean Intellectual Property Office on Jun. 29, 2011, the entire contents of which are incorporated herein by reference.

BACKGROUND OF THE INVENTION (a) Field of the Invention

The present invention relates to a steel plate with a layered structure. More specifically, the present invention relates to a method for manufacturing the steel plate with a layered structure ad that is capable of obtaining strength and ductility together.

(b) Description of the Related Art

A lot of steel is used in a car. Therefore, it is necessary to reduce weight of the car by reducing usage of steel in order to improve fuel consumption efficiency of the car or reduce discharging gas. However, the strength of the steel must be obtained with ductility thereof in order to secure safety of the car against an outer impact. Therefore, it is necessary to develop steel that is capable of obtaining strength and ductility together.

For this, martensitic steels such as DP (dual phase) steel and TRIP (transformation induced plasticity) steel have been developed as steel for cars. Ductility of DP steel or TRIP steel is increased by precisely controlling microstructures thereof. The martensitic steel cannot be used as steel for cars since ductility thereof is low even if it shows high strength of not less than 1000 MPa. Therefore, ductility of the martensitic steel should be increased when used as steel for cars, but although methods for designing alloys, removing impurities, and controlling microstructures are performed to control properties of the steel, these attempts have reached a limit.

SUMMARY OF THE INVENTION

A method for manufacturing a steel plate with a layered structure that is capable of obtaining strength and ductility is provided.

A method for manufacturing the steel plate according to an embodiment of the present invention includes i) providing a high carbon steel plate, ii) homogenizing the high carbon steel plate, iii) transforming the high carbon steel plate into an austenitic phase by heating the high carbon steel plate, iv) contacting the high carbon steel plate with an oxidization gas and converting the high carbon steel plate into a steel plate including surface layers that are spaced apart from each other and being decarburized and transformed into a ferritic phase, and a center layer that is located between the surface layers and is not decarburized, and v) cooling the high carbon steel plate and transforming the center layer into a martensitic phase.

The method for manufacturing the steel plate according to an embodiment of the present invention may further include tempering the high carbon steel plate. The oxidization gas may contain at least one gas selected from a group of hydrogen, carbon dioxide, and steam in the converting the high carbon steel plate.

The high carbon steel plate may be heated at a temperature of a range from 700° C. to 1100° C. while being decarburized. The high carbon steel plate may be firstly decarburized at a temperature of not less than 910° C. and then may be secondly decarburized at a temperature of less than 910° C. during decarburization of the high carbon steel plate. A ratio of a partial pressure of hydrogen to a sum of partial pressures of hydrogen and steam may be not less than 0.7 if the oxidization gas contains hydrogen and steam. The high carbon steel plate may contain C at 0.4 to 1 wt % and the rest of Fe and impurities in the providing the high carbon steel plate. Heating temperature of the high carbon steel plate may be in a range from 750° C. to 850° C. in the transforming the high carbon steel plate into an austenitic phase. A thickness of the high carbon steel plate may be in a range from 3 mm to 5 mm in the providing the high carbon steel plate.

Since each layer of the steel plate is combined together not by using a physical method but by a chemical method, combination of the steel plates is good. In addition, a layer of steel with high strength, ductility, and good combination is manufactured, and thereby a steel plate with high strength and ductility can be manufactured. Meanwhile, it is desirable to recycle a steel plate since the steel plate with a layered structure is manufactured from single high carbon steel without combining various steel plates with each other to manufacture the steel plate with a layered structure.

DETAILED DESCRIPTION OF THE EMBODIMENTS

The technical terms used herein are to simply mention a particular exemplary embodiment and are not meant to limit the present invention. An expression used in the singular encompasses the expression of the plural, unless it has a clearly different meaning in the context. In the present invention, it is to be understood that the terms such as "including" "having," etc., are intended to indicate the existence of specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have the same meanings as the contextual meanings in the relevant field of art, and are not to be interpreted to have idealized or excessively formal meanings unless clearly defined in the present application.

The exemplary embodiments of the present invention described with reference to perspective views and sectional views substantially represent the ideal exemplary embodiments of the present invention. As those skilled in the art would realize, the described embodiments may be modified in various different ways, all without departing from the spirit or scope of the present invention.

Figure 1:
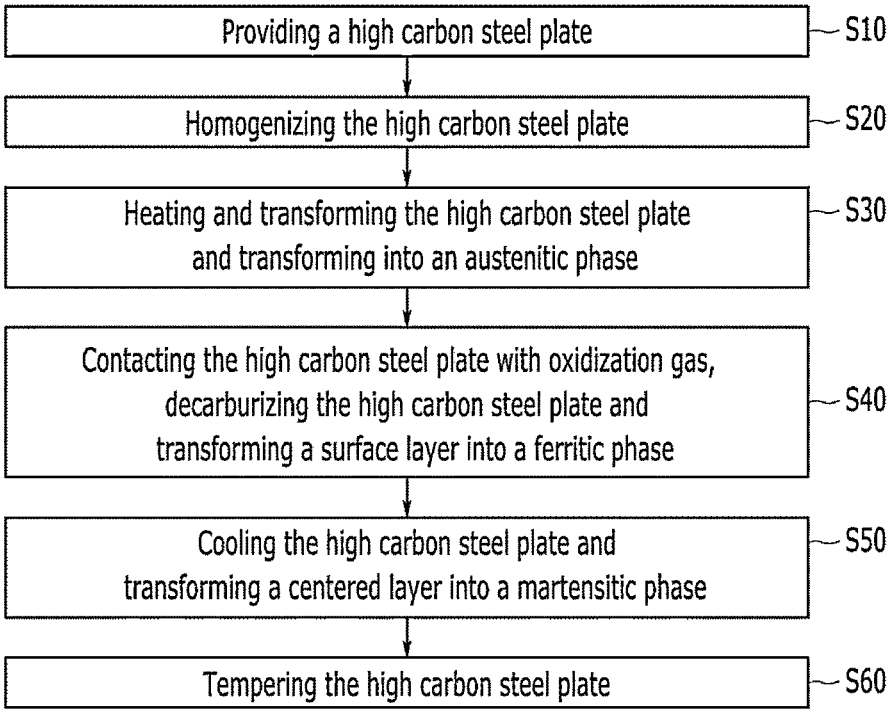
FIG. 1 is a flowchart schematically showing a method for manufacturing a steel plate according to an embodiment of the present invention.

FIG. 1 schematically shows a flowchart of a method for manufacturing a steel plate according to an embodiment of the present invention. The method for manufacturing the steel plate of FIG. 1 is merely to illustrate the present invention, and the present invention is not limited thereto. Therefore, the method for manufacturing the steel plate can have other forms.

As shown in FIG. 1, the method for manufacturing the steel plate includes providing a high carbon steel plate (S10), homogenizing the high carbon steel plate S20, heating the high carbon steel plate and transforming it into an austenitic phase (S30), and decarburizing the high carbon steel plate by contacting it with an oxidization gas and transforming it into a ferritic phase (S40), transforming a center layer into a martensitic layer by cooling the high carbon steel plate (S50), and tempering the high carbon steel plate (S60). Further, the method for manufacturing the steel plate may include other steps as necessary, and step S60 can be omitted if possible.

FIGS. 2 to 5 schematically show processes for transforming a sectional structure of the steel plate of each step of a method for manufacturing a steel plate of FIG. 1, respectively. The sectional structures of the steel plate of FIGS. 2 to 5 are merely to illustrate the present invention, and the present invention is not limited thereto. Therefore, the sectional structures of the steel plate of FIGS. 2 to 5 can have other forms. The method for manufacturing the steel plate according to an embodiment of the present invention is explained with reference to FIGS. 1 to 5 in detail below.

Figure 2:
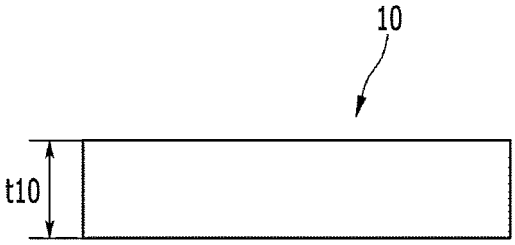
FIGS. 2 to 5 schematically show processes of deforming sectional structures of the steel plate of each step of the method for manufacturing the steel plate of FIG. 1.

Firstly, as shown in FIG. 1, a high carbon steel plate 10 is provided in step S10 (shown in FIG. 2). Here, the high carbon steel plate 10 contains Cat 0.4 wt % to 1 wt % and rest as Fe and impurities. It is necessary for the contents of the compacted materials contained in the high carbon steel plate 10 to be not less than a certain level in order to maintain strength of the steel plate. However, if the strength of the steel plate 20 is too high, elongation of the steel plate may be very low, thereby the content of the C contained in the high carbon steel plate is maintained to be not more than a certain level. As a result, a high carbon steel plate 10 with a suitable strength can be manufactured. Since a method for manufacturing the high carbon steel plate 10 can be understood by those skilled in the art, a detailed explanation thereof is omitted.

A thickness t10 of the high carbon steel plate 10 may be in a range of 0.5 mm to 3 mm. If the thickness t10 of the high carbon steel plate 10 is less than 0.5 mm, industrial applicability is deteriorated since it is too small. In addition, if the thickness t10 of the steel plate 10 is more than 3 mm, time and cost for decarburizing the steel plate 10 are largely consumed in a following step. Therefore, the thickness t10 of the steel plate 10 is controlled in the range above.

The high carbon steel plate 10 is homogenized in step S20 of FIG. 1. Therefore, an internal structure of the steel plate 10 is homogenized. Since the homogenizing process of the steel plate 10 can be easily understood by those skilled in the art, the detailed explanation thereof is omitted.

Next, the high carbon steel plate is heated to transform the internal structure thereof into an austenitic phase in step S30. For this, the high carbon steel plate can be heated at a temperature of a range from 900° C. to 1000° C. If the heating temperature of the high carbon steel plate is too low, the high carbon steel plate does not become austenitic. In addition, if the heating temperature of the high carbon steel plate is too high, the initial grain becomes large because of large energy consumption and a rapid growth speed of the grain. Therefore, the heating temperature of the high carbon steel plate is controlled in the above range.

Figure 3:
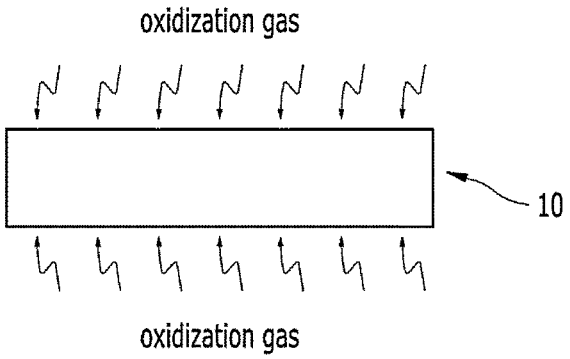
Figure 4:
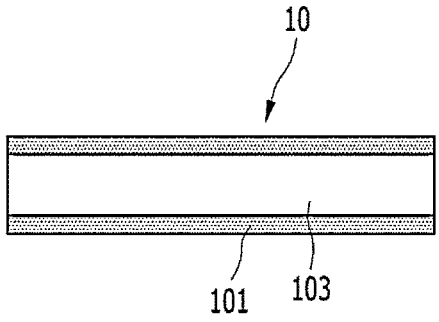

The high carbon steel plate 10 is decarburized by contacting the high carbon steel plate 10 with an oxidization gas in step S40 in FIG. 1 (shown in FIG. 3). Here, the high carbon steel plate 10 can be divided into surface layers 101 and a center layer 105 depending on decarburization. That is, the surface layers 101 are decarburized by the oxidization gas while the center layer 105 is not decarburized since it is located between the surface layers 101 and is not affected by the oxidization gas. The surface layers 101 are spaced apart from each other and are heated to be decarburized to be transformed into a ferritic phase. Therefore, ductility of the high carbon steel plate 10 can be obtained by the surface layer 101. The center layer 105 is located between the surface layers 101. The high carbon steel plate 10 can further include other layers if necessary.

More specifically, carbon contained in the high carbon steel plate 10 is removed by reaction between the high carbon steel plate 10 as a solid and the oxidization gas as a gas by using a solid iron making process in step S40. For example, a bright annealing method may be used.

The oxidization gas reacts with the high carbon steel plate 10, and thereby carbon contained in the high carbon steel plate 10 can be easily removed. For this, the high carbon steel plate 10 is heated at a temperature of a range from 700° C. to 1100° C. to be decarburized. If the heating temperature of the high carbon steel plate 10 is less than 700° C., the reaction between the high carbon steel plate 10 and the oxidization gas may not easily occur. In addition, if the heating temperature of the high carbon steel plate 10 is over 1100° C., the high carbon steel plate 10 can be easily oxidized. Therefore, the heating temperature of the high carbon steel plate 10 is controlled in the above range. The high carbon steel plate 10 can be easily heated to react with the oxidization gas by loading the high carbon steel plate 10 and injecting the oxidization gas into a decarburization furnace to heat the high carbon steel plate 10.

Here, the oxidization gas may include hydrogen ($H_2$), carbon dioxide ($CO_2$), steam ($H_2O$), and so on. As described in Chemical Formula 1, since the carbon dioxide ($CO_2$) or steam ($H_2O$) reacts with C contained in the high carbon steel plate 10, thereby generating a gas such as carbon monoxide (CO), carbon dioxide $CO_2$), and hydrogen ($H_2$), carbon can be effectively removed from the high carbon steel plate 10.

$$CO_2+C \rightarrow 2CO$$

$$2H_2O+C \rightarrow CO_2+2H_2 \qquad \text{[Chemical Formula 1]}$$

Meanwhile, the high carbon steel plate 10 can be decarburized by using another method in step S40. That is, when the high carbon steel plate 10 is decarburized in step S40, the high carbon steel plate 10 is firstly decarburized at a temperature of not less than 910° C., and is then secondly decarburized at a temperature of less than 910° C. Therefore, contents of the carbon contained in the high carbon steel plate 10 can be effectively reduced by the first decarburizing process. In addition, a ferritic phase is formed on the surface of the steel plate by the second decarburization at a low temperature, and thereby a layered structure including ferritic and austenitic phases is formed.

Meanwhile, when the high carbon steel plate 10 is decarburized, the surface of the high carbon steel plate 10 can be oxidized by the oxidization gas. Therefore, when hydrogen and steam are used for preventing the surface of the high carbon steel plate 10 from being oxidized, a ratio of a partial pressure of the hydrogen to a sum of partial pressures of the hydrogen and the steam is controlled to be not less than 0.7. If the ratio of the partial pressure of the hydrogen to a sum of partial pressures of the hydrogen and steam is not less than 0.7, austenite is more stable than wustite at a temperature of not less than 800° C., and thereby the steel plate is not oxidized. If the partial pressure of the oxidization gas is too low, carbon is not removed well from the high carbon steel plate 10. On the contrary, if the partial pressure of the oxidization gas is too high, the high carbon steel plate 10 can be oxidized. Therefore, the partial pressure of the oxidization gas is controlled in the above range. Meanwhile, if decarburization of the high carbon steel plate 10 is completed, micro-sized pores are shown on the surface of the high carbon steel plate 10 due to the decarburization. Therefore, a following process is advanced after the surface of the high carbon steel plate 10 is smoothed by using sandpaper, a surface grinder, etc.

Figure 5:
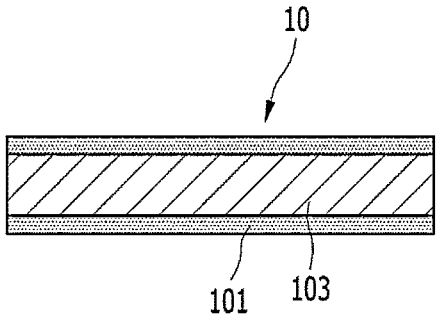

Next, the center layer 103 is transformed into a martensitic phase by cooling the high carbon steel plate 10 in step S50 of FIG. 1 (shown in FIG. 5). For example, the high carbon steel plate 10 is cooled by water and the center layer 103 can be transformed into the martensitic phase.

Finally, the high carbon steel plate is tempered in step S60 of FIG. 1 if necessary. That is, the high carbon steel plate can be tempered in order to alleviate fatigue of the transformed martensitic phase in step S50. In this case, the tempering temperature of the high carbon steel plate may be in a range from 150° C. to 300° C. If the tempering temperature is too low, tempering is not performed well due to the low diffusion rate of the carbon, and thereby brittleness of the martensitic phase is not alleviated. In addition, if the tempering temperature is too high, cementite particles are generated between the martensitic phases, and thereby ductility of the high carbon steel plate is deteriorated. Therefore, the tempering temperature of the high carbon steel plate is controlled in the above range.

Figure 6:
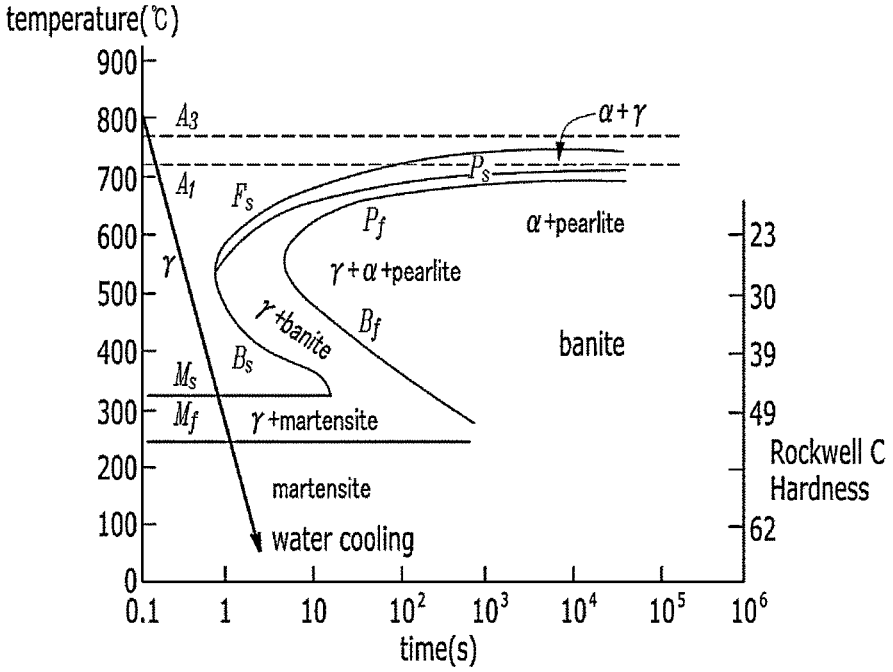
FIG. 6 is a TTT diagram schematically showing a step of martensitic transforming of a center layer of FIG. 1.

FIG. 6 is a TTT diagram schematically showing step S50 of FIG. 1. More specifically, FIG. 6 shows a process of transforming the center layer 103 (shown in FIG. 4) of the austenitic phase into a martensitic phase by cooling the high carbon steel plate 10 (shown in FIG. 4, referred to as the same hereinafter).

As indicated by an arrow in FIG. 6, when the high carbon steel plate 10 is quenched by water, the center layer 103 of the austenitic phase is transformed into the martensitic phase since it is unstable at room temperature. As a result, strength of the high carbon steel plate 10 can be improved. Since the high carbon steel plate 10 is quenched, it does not pass through a banite phase generating region or a pearlite phase generating region in the TTT diagram of FIG. 6. Therefore, the center layer 103 is cooled without phase transformation, and thereby an austenitic phase is transformed into a martensitic phase. Meanwhile, since the surface layer 101 of the ferritic phase is stable at room temperature, it is not transformed into another phase and it remains as it is.

Since the surface layer 101 and the center layer 103 are combined with each other not physically but chemically in the high carbon steel plate manufactured by using the above steel plate manufacturing method, a bonding structure thereof is basically strong. Furthermore, since the high carbon steel plate 10 manufactured by using the above steel plate manufacturing method has a layered structure, both the strength and toughness thereof are good due to complex properties of each layer. Therefore, a steel plate with a complex structure and good properties can be manufactured by using a simple method.

On the contrary, steel plates with layered structures manufactured by physically combining each layer according to the conventional method, for example, a layered structural steel plate, which is manufactured by stacking SUS420, SUS304, and SUS420 steel plates in order, also shows high strength and elongation. However, since the layered structural steel plate is manufactured by using a hot bonding process, a large processing cost is consumed. In addition, a surface of each layer can be oxidized during the hot bonding process. High strength and high ductility, properties that can be obtained from the layered structural steel, highly depend on strong bonding of each layer. However, since each layer is physically combined by a rolling method etc. in the conventional method, there is a limitation to realize optimum properties.

On the contrary, since a layered structural steel plate is provided by using a chemical method in an embodiment of the present invention, ductility and strength of the steel plate can be substantially improved together. Therefore, steel plates capable of being used in car production can be easily manufactured.

The present invention is explained in detail below with reference to exemplary examples. The exemplary examples are merely to illustrate the present invention and the present invention is not limited thereto.

EXEMPLARY EXAMPLES

Figure 7:
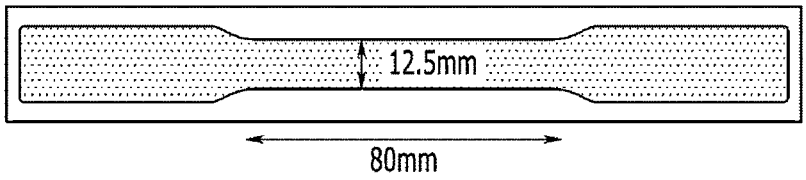
FIG. 7 is a drawing of a specimen used in Exemplary Examples 1 to 9 of the present invention and a comparative example.

An experiment was performed with a specimen prepared by uniformly rolling a steel plate with a thickness of 10 mm to a thickness of 1 mm. Here, the specimen contained C at 0.45 wt %, Mn at 0.7 wt % and Si at 0.2 wt %. The specimen was manufactured to be a standard specimen for an elongation test. FIG. 7 is a drawing showing the specimen used in the exemplary examples. A length of a middle portion with a concave shape of the specimen was 80 mm and a width thereof was 12.5 mm.

Exemplary Example 1

The specimen was homogenized at 1000° C. for 1 minute and then was cooled by air. In addition, the specimen was heated at 850° C. for 1 minute in order to make the phase uniform to be transformed into austenite and was then cooled by air. Next, the specimen was decarburized at 770° C. for 30 minutes. A mixed gas of $H_2$ and $H_2O$ was used as an oxidization gas for decarburization. The specimen was cooled by water after being decarburized. The specimen was tempered at 180° C. for 60 minutes in order to alleviate internal stress of the martensitic phase generated by cooling the specimen by water.

Exemplary Example 2

The specimen was decarburized at 770° C. for 60 minutes. The rest of the experimental procedure was the same as that of Exemplary Example 1.

Exemplary Example 3

The specimen was decarburized at 770° C. for 90 minutes. The rest of the experimental procedure was the same as that of Exemplary Example 1.

Exemplary Example 4

The specimen was decarburized at 770° C. for 120 minutes. Rest of the experimental procedure was the same as that of Exemplary Example 1.

Exemplary Example 5

The specimen was decarburized at 850° C. for 30 minutes. The rest of the experimental procedure was the same as that of Exemplary Example 1.

Exemplary Example 6

The specimen was decarburized at 850° C. for 60 minutes. The rest of the experimental procedure was the same as that of Exemplary Example 1.

Exemplary Example 7

The specimen was decarburized at 850° C. for 90 minutes. The rest of the experimental procedure was the same as that of Exemplary Example 1.

Exemplary Example 8

The specimen was decarburized at 850° C. for 120 minutes. The rest of the experimental procedure was the same as that of Exemplary Example 1.

Exemplary Example 9

The specimen was tempered at 270° C. for 60 minutes in order to alleviate internal stress of the martensitic phase of the specimen after decarburization. The rest of the experimental procedure was the same as that of Exemplary Example 2.

Figure 8:
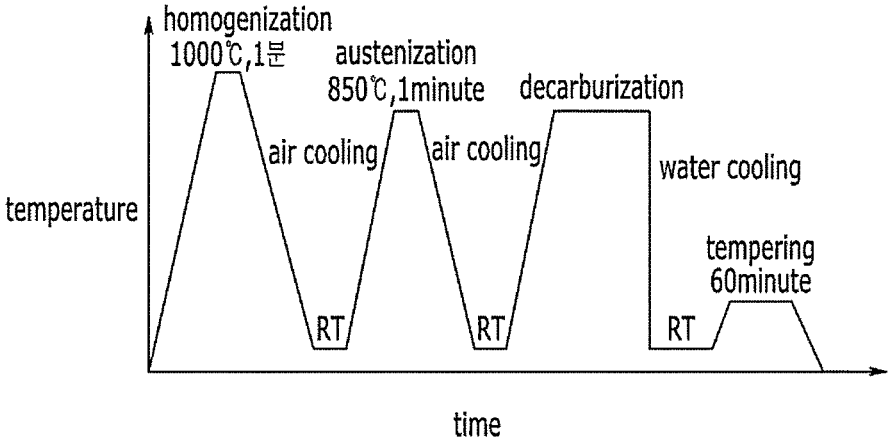
FIG. 8 is a graph schematically showing processes of Exemplary Examples 1 to 9.
Figure 9:
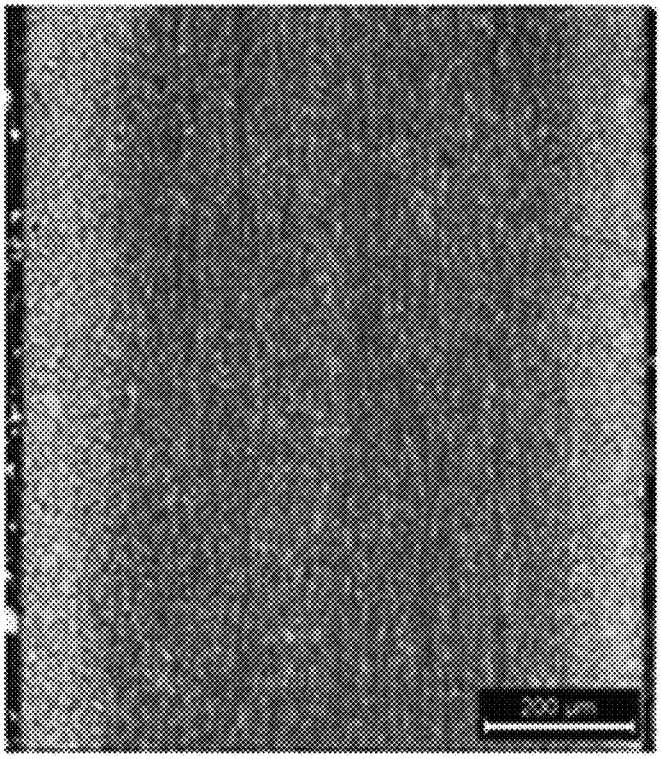
FIGS. 9 to 16 are photographs of specimens manufactured according to Exemplary Examples 1 to 8, respectively.
Figure 10:
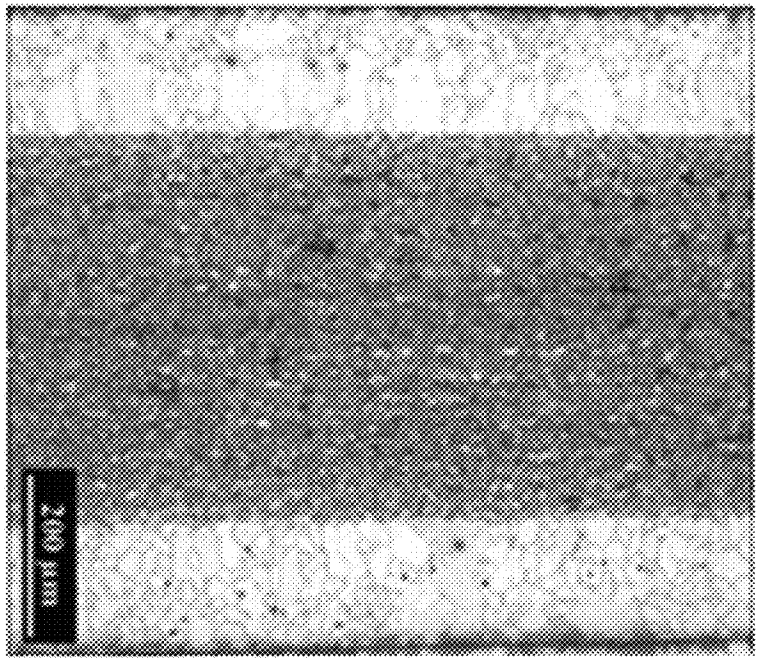
Figure 11:
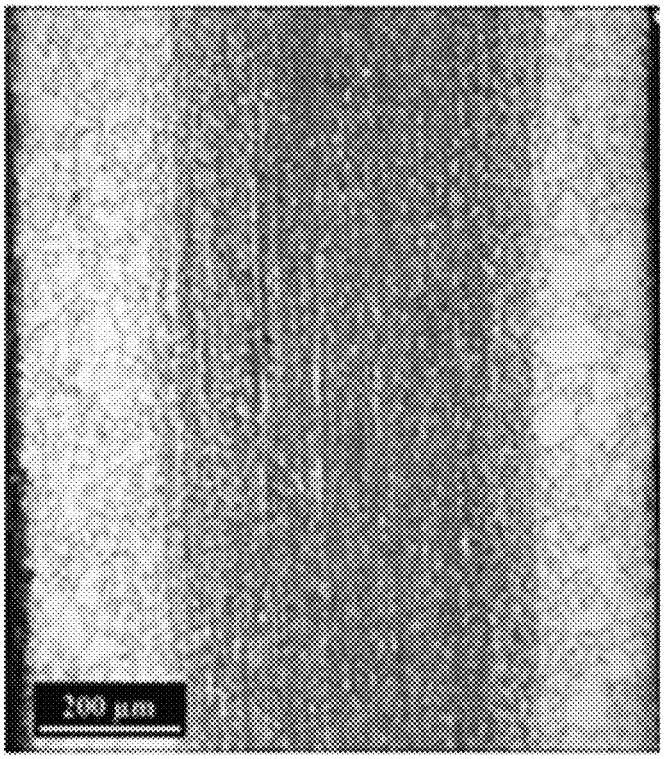
Figure 12:
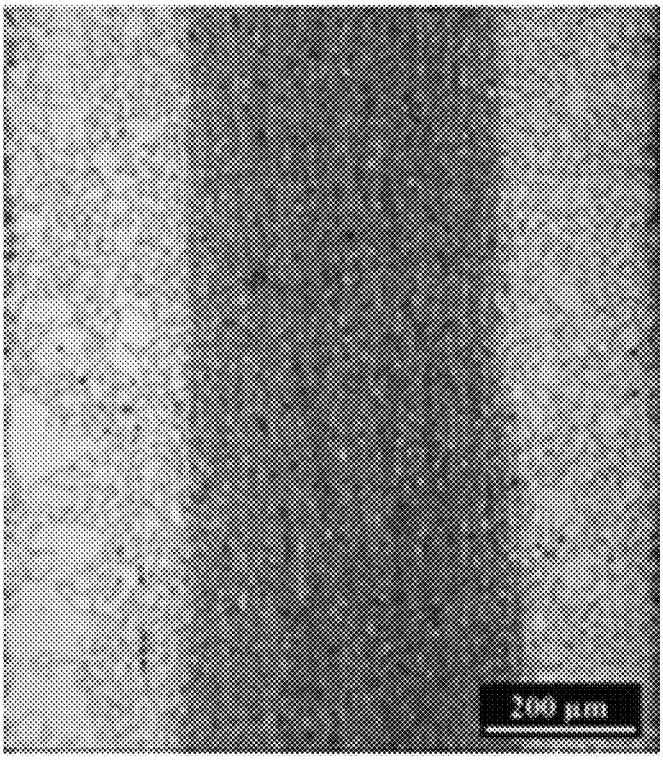
Figure 13:
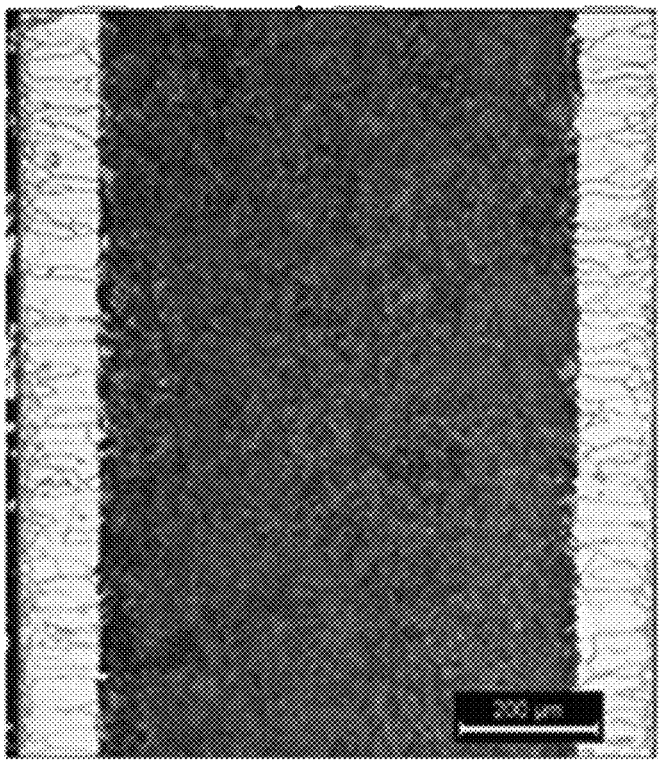
Figure 14:
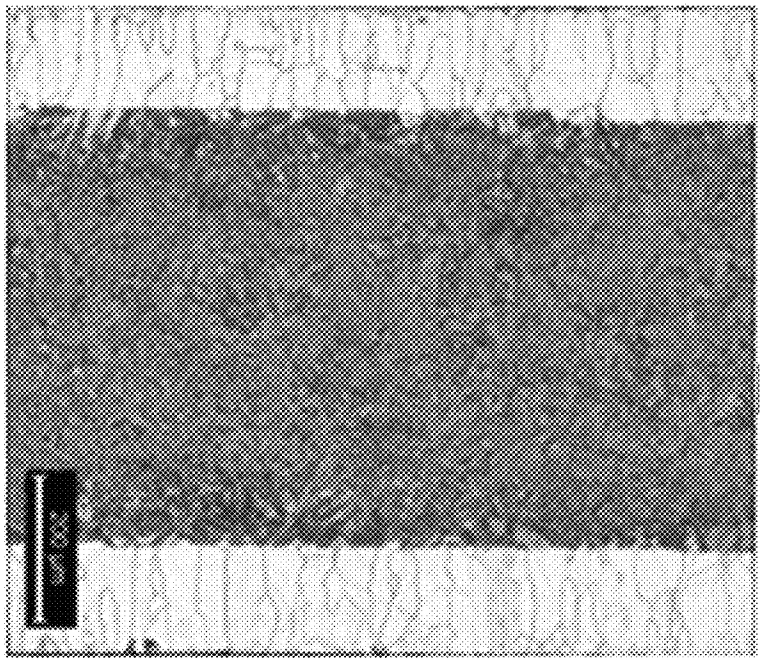
Figure 15:
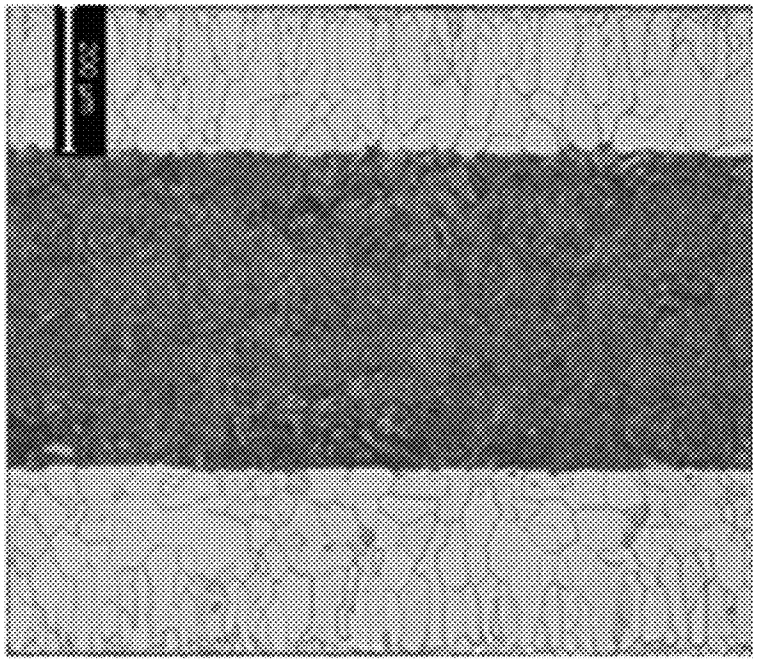
Figure 16:
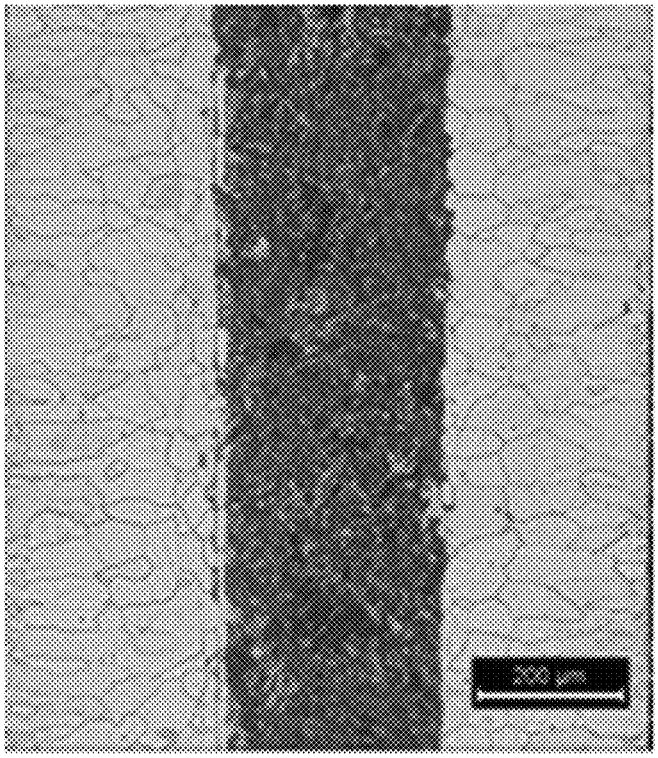

FIG. 8 schematically shows a graph regarding processes of the above Exemplary Examples 1 to 9. As shown in FIG. 8, a complex layered structure was manufactured by homogenizing, cooling by air, austenitizing, cooling by air, decarburization, cooling by water, and tempering each specimen of the above Exemplary Examples 1 to 9. Decarburization time, Decarburization temperature, and tempering temperature were differently controlled in Exemplary Experiments 1 to 9.

Comparative Example

The specimen was prepared to uniformly roll a steel plate with a thickness of 10 mm to a thickness of 1 mm. The specimen contained C at 0.45 wt %, Mn at 0.7 wt %, and Si at 0.2 wt %. The specimen was manufactured to be a standard specimen for a tensile test to have a shape shown in FIG. 7.

Experimental Results

Specimen Structure Observation Result

FIGS. 9 to 16 are photographs showing specimens manufactured according to the above Exemplary Examples 1 to 8, respectively.

As a result of observing the specimens manufactured according to the above Exemplary Examples 1 to 8, a ferritic phase was generated at a surface layer thereof while a martensitic phase was uniformly generated at a center layer thereof. However, there was a big difference between microstructures of the surface layer and those of the center layer because each of the decarburization conditions of Exemplary Examples 1 to 8 are different from each other.

Result of a Tensile Test

A tensile test was performed in order to determine the properties of the specimens with a layered structure manufactured according to Exemplary Examples 1 to 9 and comparative example. Table 1 shows elongation and tensile strength according to the tensile test.

TABLE 1

| NO | Examples | Tensile strength (MPa) | Elongation (%) |
|---|---|---|---|
| 1 | Exemplary Example 1 | 1348.45 | 4.56521 |
| 2 | Exemplary Example 2 | 1201.02 | 5.96102 |
| 3 | Exemplary Example 3 | 1346.64 | 5.46039 |
| 4 | Exemplary Example 4 | 1416.91 | 3.97401 |
| 5 | Exemplary Example 5 | 1239.07 | 5.23429 |
| 6 | Exemplary Example 6 | 579.34 | 18.46456 |
| 7 | Exemplary Example 7 | 547.3441 | 18.57742 |
| 8 | Exemplary Example 8 | 711.2831 | 10.48404 |
| 9 | Exemplary Example 9 | 751.1231 | 13.12312 |
| 10 | Comparative Example | 1077.33 | 3.42685 |

As described in Table 1, according to Exemplary Examples 1 to 9, the tensile strengths and elongations of the specimen were observed to be varied depending on decarburization temperature and decarburization time. A ratio of a ferritic phase and a martensitic phase was controlled by changing the decarburization time. If an amount of ferritic phase was large, the strength of the specimen was reduced since the strength of the specimen is lower than that of the martensitic phase. In addition, the strength of the specimen was lowered while ductility thereof was increased by changing the thickness of a layered structure of the specimen and microstructures thereof by controlling the decarburization temperature and decarburization time.

More specifically, if the decarburization temperature was 850° C., the specimen showed high tensile strength since an internal structure of the specimen was only formed of the martensitic phase. In addition, the tensile strength of the specimen was reduced as the decarburization time of the specimen became longer and then the ferritic phase was increased. When the decarburization temperature was 770° C., the tensile strength of the specimen was reduced while elongation thereof was increased since the martnesitic phase and the ferritic phase were mixed in the specimen. Differences in the tensile strength test of Exemplary Examples 2 and 9 and the comparative example were observed by using another tensile strength test.

Figure 17:
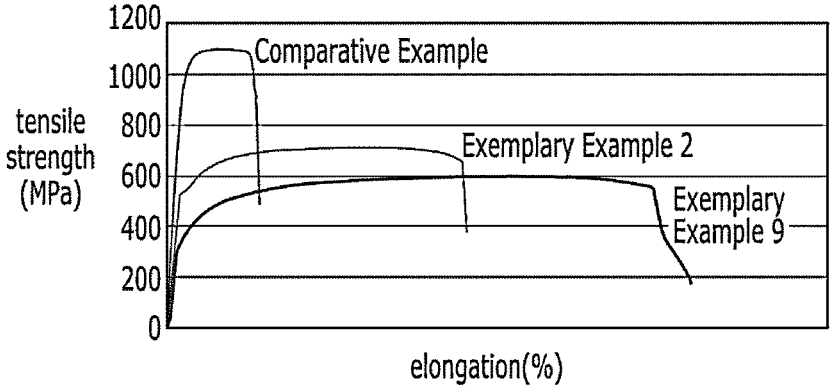
FIG. 17 is a graph showing tensile strength and elongation of the specimens manufactured according to Exemplary Examples 2 and 9 of the present invention and a comparative example.

FIG. 17 is a graph showing results of tensile tests of the specimens manufactured according to Exemplary Examples 2 and 9 and the comparative example.

As shown in FIG. 17, elongation of the specimen manufactured according to the comparative example is very low while the elongations of the specimens manufactured according to the Exemplary Examples 2 and 9 are very high. Particularly, elongation of the specimen manufactured according to Exemplary Example 9 was observed to be greater than that manufactured according to Exemplary Example 2.

Figure 18:
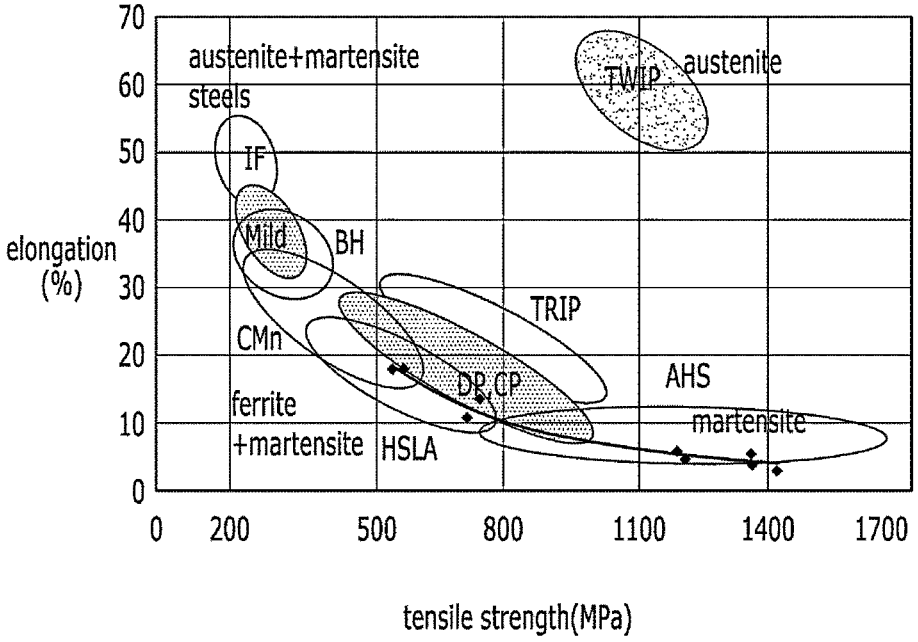
FIG. 18 is a diagram showing ductility and tensile strength of specimens manufactured according to Exemplary Examples 1 to 9.

FIG. 18 is a diagram showing elongations and tensile strengths of the specimens manufactured according to Exemplary Examples 1 to 9.

Microstructures of the layered structural specimens containing the surface layer and the center layer were changed by controlling variables. As a result, the specimens show a variety of properties according to a change of the microstructure.

As shown in FIG. 18, a plurality of dots represent tensile strengths and elongations of the specimens according to Exemplary Examples 1 to 8. That is, the specimens showed similar properties to those of theoretical steel containing both the ferritic and martensitic phases. Therefore, specimens with good properties were obtained without using a complex and expensive process, adding elements for alloying, or using a strengthening mechanism.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for manufacturing a steel plate, the method comprising:

providing a high carbon steel plate containing C at 0.4 wt % to 1 wt %;

homogenizing the high carbon steel plate;

transforming the high carbon steel plate into an austenitic phase by heating the high carbon steel plate;

contacting the high carbon steel plate with an oxidization gas and converting the high carbon steel plate into a steel plate comprising surface layers that are spaced apart from each other and being decarburized and transformed into a ferritic phase, and a center layer that is located between the surface layers and is not decarburized; and cooling the high carbon steel plate and transforming the center layer into a martensitic phase.

2. The method of claim 1, further comprising tempering the high carbon steel plate.

3. The method of claim 1, wherein the oxidization gas contains at least one gas selected from the group consisting of hydrogen, carbon dioxide, and steam in the converting the high carbon steel plate.

4. The method of claim 3, wherein the high carbon steel plate is heated at a temperature within a range from 700° C. to 1100° C. while being decarburized.

5. The method of claim 4, wherein the high carbon steel plate is firstly decarburized at a temperature of not less than 910° C. and then is secondly decarburized at a temperature of less than 910° C. during decarburization of the high carbon steel plate.

6. The method of claim 3, wherein a ratio of a partial pressure of hydrogen to a sum of partial pressures of hydrogen and steam is not less than 0.7 if the oxidization gas contains hydrogen and steam.

7. The method of claim 1, wherein the high carbon steel plate contains C at 0.4 to 1 wt % and the rest of Fe and impurities in the providing the high carbon steel plate.

8. The method of claim 1, wherein a heating temperature of the high carbon steel plate is within a range from 750° C. to 850° C. in the transforming the high carbon steel plate into an austenitic phase.

9. The method of claim 1, wherein a thickness of the high carbon steel plate is within a range from 3 mm to 5 mm in the providing the high carbon steel plate.

* * * * *